US007711124B2

(12) United States Patent
Garabedian

(10) Patent No.: US 7,711,124 B2
(45) Date of Patent: May 4, 2010

(54) METHOD AND DEVICE FOR ATTENUATING THE NOISE GENERATED AT THE OUTLET OF AN EXHAUST LINE

(75) Inventor: Christian Garabedian, Voujeaucourt (FR)

(73) Assignee: Faurecia Systemes d'Echappement, Nanterre (FR)

( * ) Notice: Subject to any disclaimer, the term of this patent is extended or adjusted under 35 U.S.C. 154(b) by 743 days.

(21) Appl. No.: 10/559,934

(22) PCT Filed: Jun. 9, 2004

(86) PCT No.: PCT/FR2004/001442

§ 371 (c)(1),
(2), (4) Date: May 3, 2006

(87) PCT Pub. No.: WO2004/111397

PCT Pub. Date: Dec. 23, 2004

(65) Prior Publication Data

US 2007/0071250 A1 Mar. 29, 2007

(30) Foreign Application Priority Data

Jun. 10, 2003 (FR) ..... 03 06942

(51) Int. Cl.

| | |
|---|---|
| ***G10K 11/16*** | (2006.01) |
| ***H04B 15/00*** | (2006.01) |
| ***H04R 29/00*** | (2006.01) |
| ***F01N 1/06*** | (2006.01) |
| ***F41A 21/00*** | (2006.01) |
| ***E04F 17/04*** | (2006.01) |
| ***F01N 13/08*** | (2010.01) |
| ***F02K 1/00*** | (2006.01) |

(52) U.S. Cl. ..... 381/71.5; 381/71.4; 381/71.1; 381/71.7; 381/71.9; 381/94.1; 381/56; 181/206; 181/223; 181/224; 181/227; 181/228; 181/212; 181/213

(58) Field of Classification Search ..... 381/71.1–71.13, 381/94.1, 56, 71.4, 71.5; 181/206, 223–228, 181/212, 213

See application file for complete search history.

(56) References Cited

U.S. PATENT DOCUMENTS

| | | | | |
|---|---|---|---|---|
| 4,527,282 | A * | 7/1985 | Chaplin et al. | 381/71.5 |
| 5,414,230 | A | 5/1995 | Bax et al. | |
| 5,431,008 | A | 7/1995 | Ross et al. | |
| 5,432,857 | A * | 7/1995 | Geddes | 381/71.7 |
| 5,457,749 | A * | 10/1995 | Cain et al. | 381/71.5 |
| 6,160,892 | A * | 12/2000 | Ver | 381/71.5 |

FOREIGN PATENT DOCUMENTS

EP 0455375 11/1991

OTHER PUBLICATIONS

Neues Elektronisches Schalldaempfer-System, Atz Automobiltechnische Zeitschrift, Franckh'sche Verlagshandlung, Stuttgart, Germany, vol. 92, No. 10, Oct. 1, 1990 p. 565.

International Search Report, priority application PCT/FR2004/001442 filed Jun. 9, 2004.

* cited by examiner

*Primary Examiner*—Devona E Faulk
(74) *Attorney, Agent, or Firm*—Young & Thompson

(57) ABSTRACT

A method for attenuating the low-frequency noise generated at the outlet (18) of an exhaust line (14). A signal representing the noise to be attenuated is defined; a first high-frequency acoustic wave (F1) is emitted from a first transducer (22) into an attenuation region (26) of the exhaust line (14), the first acoustic wave having a carrier frequency higher than 50 kHz; and a second high-frequency acoustic wave ($F1+\Delta f_{cb}$) is emitted by a second transducer (24) into the attenuation region (26) of the exhaust line, the second acoustic wave having the carrier frequency of the first high-frequency acoustic wave (F1) and containing a low-frequency counter-noise signal ($\Delta f_{cb}$) which is out of phase with the signal representing the noise to be attenuated.

16 Claims, 1 Drawing Sheet

METHOD AND DEVICE FOR ATTENUATING THE NOISE GENERATED AT THE OUTLET OF AN EXHAUST LINE

BACKGROUND OF THE INVENTION

The present invention relates to a method and a device for attenuating the noise generated at the outlet of an exhaust line.

Eighty percent of the noise emitted by a motor vehicle powered by a heat engine is caused by the engine. The exhaust system of the vehicle therefore has to be designed to reduce the sound level detected by residents.

The provision of an active noise control device in the exhaust line is known. This device allows the noise that is to be attenuated to be neutralized by causing interference between the noise to be attenuated and a counter-noise, which has the same frequency and the same amplitude but is in opposition of phase. The counter-noise is produced electronically using signal processing algorithms, in order to generate destructive interference with the noise to be attenuated.

The sound wave forming the counter-noise is generated by electromagnetic loudspeakers. In the known solutions, the loudspeakers directly produce a sound wave having the characteristics of the counter-noise. In order to be effective, said loudspeakers have to have an electrical power from 100 to 150 W and a mass of between 2 and 4 kg.

The current active noise control solutions are therefore relatively heavy and bulky.

SUMMARY OF THE INVENTION

The object of the invention is to propose a lighter device for attenuating noise generated by a heat engine.

The invention accordingly relates to a method for attenuating noise generated at the outlet of an exhaust line, wherein it comprises the steps of:

defining a signal representing the noise to be attenuated, emitting a first high-frequency sound wave from a first transducer into an attenuation zone of the exhaust line, which first high-frequency sound wave is inaudible and has a carrier frequency of higher than 50 kHz, and emitting a second high-frequency sound wave from a second transducer into the attenuation zone of the exhaust line, the first and second transducers being configured for generating interference between the first and second sound waves in the attenuation zone, which second sound wave is inaudible and has as its carrier frequency the carrier frequency of the first high-frequency sound wave and contains a low-frequency counter-noise signal, which is in opposition of phase to the signal representing the noise to be attenuated.

According to particular embodiments, the attenuation method utilizes one or more of the following characteristics:

the frequency of the counter-noise signal is between 10 and 1,000 Hz, and the carrier frequency is substantially equal to 100 kHz.

The invention also relates to a device for attenuating the noise generated at the outlet of an exhaust line, wherein it comprises;

means for defining a signal representing the noise to be attenuated, means for producing a low-frequency counter-noise signal, which is in opposition of phase to the signal representing the noise to be attenuated, a first and a second transducer arranged in an attenuation zone of the exhaust line, the first and second transducers being configured for generating interference between the sound waves that are produced and present in the attenuation zone, means for controlling the first transducer for emitting a first high-frequency sound wave, which first high-frequency sound wave is inaudible and has a carrier frequency of higher than 50 kHz, and means for controlling the second transducer for emitting a second high-frequency sound wave, which second high-frequency sound wave is inaudible and has as its carrier frequency the carrier frequency of the first high-frequency sound wave and contains the low-frequency counter-noise signal, which is in opposition of phase to the signal representing the noise to be attenuated.

According to particular embodiments, the device comprises one or more of the following characteristics:

the first and second transducers are piezoelectric transducers, said piezoelectric transducers are lead zirconate titanate-based, said means for defining a noise signal comprise a microphone for recording the residual noise at the outlet of the exhaust line, and said means for defining a noise signal comprise a unit for monitoring the ignition frequency of the engine.

Finally, the invention relates to an installation for powering a motor vehicle, wherein it comprises a heat engine, an exhaust line and a noise attenuation device as described above, the first and second transducers being arranged on the exhaust line.

BRIEF DESCRIPTION OF THE DRAWINGS

A better understanding of the invention will be facilitated by reading the following description, which is given solely by way of example and with reference to the drawings, in which.

DESCRIPTION OF THE PREFERRED EMBODIMENT

Figure 1:
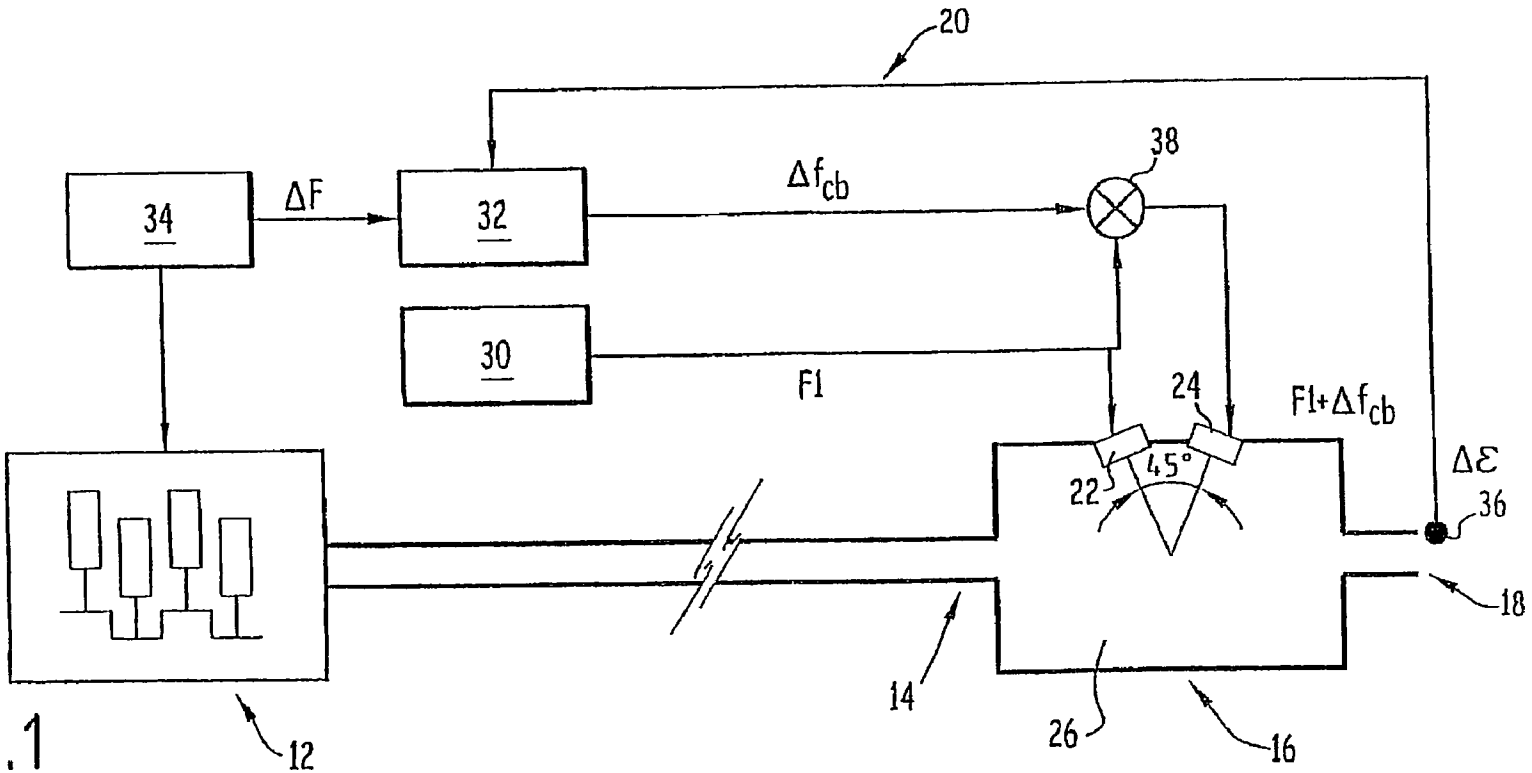
FIG. 1 is a schematic view of an installation for powering a motor vehicle, which installation is provided with a noise attenuation device according to the invention.

The power installation illustrated in FIG. 1 basically comprises a heat engine 12, at the outlet of which an exhaust line 14 is connected.

The exhaust line comprises, as is known per se, an exhaust silencer 16. It opens at an end 18 for releasing exhaust gases.

The power installation is provided with a sound attenuation device 20, which comprises two sound wave sources 22, 24, which are capable of producing sound waves in the silencer 16, which delimits a noise attenuating space 26.

The two sources 22, 24 are formed by piezoelectric transducers. These transducers are advantageously lead zirconate titanate or "PZT"-based.

The two transducers are joined to the wall of the silencer 16 and are configured so as to generate interference, on the one hand, between the sound waves produced by these transducers and, on the other hand, between the waves produced by these transducers and the sound wave produced by the circulation of the exhaust gases.

The main emission axes of the two transducers are preferably angularly offset by approximately 45°.

The device comprises a generator 30, which is capable of supplying a high-frequency signal F1 for energizing a first transducer 22 at a constant frequency and base amplitude. This frequency is preferably higher than 50 kHz so as to produce a first sound wave that is inaudible from the first transducer 22.

This frequency is, for example, substantially equal to 100 kHz.

The generator 30 is formed by an oscillator of any suitable type.

The device 20 also comprises a unit 32 for generating a counter-noise. This unit is connected to a unit 34 for controlling the engine. This unit 34 controls, as is known per se, the ignition of the engine at an ignition frequency. The unit 32 comprises means for picking up a signal ΔF representing the ignition frequency of the engine.

The device 20 also comprises a microphone 36 arranged at the outlet 18 of the exhaust line. This microphone is connected to the unit 32 for generating the counter-noise. The unit receives from the microphone a signal of the residual noise Δϵ corresponding to the attenuated noise measured at the outlet of the exhaust line.

From the signals ΔF and Δϵ, the unit 32 for generating the counter-noise produces a low-frequency counter-noise signal $\Delta f_{cb}$. The counter-noise signal $\Delta f_{cb}$ has the same frequency and the same amplitude as the signal, denoted by $\Delta f_b$ and representing the noise to be attenuated, but is in opposition of phase relative to this noise. The frequency of the counter-noise signal is therefore between 10 and 1,000 Hz.

At the outlet of the unit 32, the device 20 comprises a mixer 38, to which the source 30 is connected. The mixer 38 is therefore capable of mixing the signals $\Delta f_{cb}$ and F1. The signal denoted by $F1+\Delta f_{cb}$, which is obtained at the outlet of the mixer 38, has a carrier frequency that is identical to the frequency of the first sound wave and contains the counter-noise signal $\Delta f_{cb}$ corresponding to the signal $\Delta f_b$ representing the noise to be attenuated, but is in opposition of phase thereto.

The outlet of the mixer 38 is connected to the second transducer 24.

The attenuation device operates in the following manner:

From the residual noise signal Δϵ and the operating frequency $\Delta f_{cb}$ of the engine, the unit 32 produces a counter-noise signal $\Delta f_{cb}$. A high-frequency signal F1 is applied to the first transducer 22, whereas a high-frequency signal $F1+\Delta f_{cb}$ is applied to the second transducer 24. The sound waves produced by the first and second transducers are inaudible, these waves having a very high carrier frequency.

Figure 2:
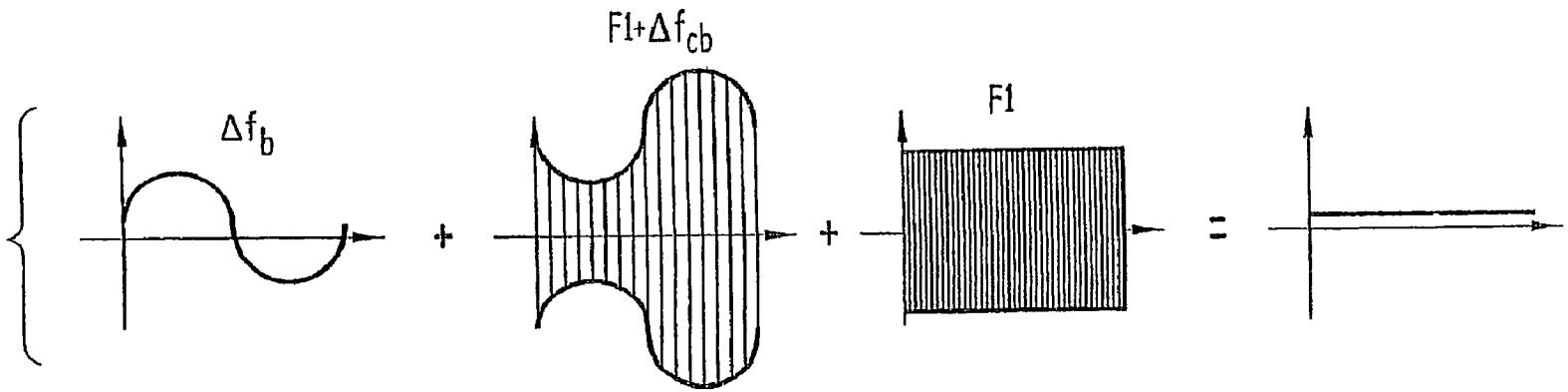
FIG. 2 is a schematic view illustrating the interference phenomenon utilized in the noise attenuation device according to the invention.

In the attenuation space 26, as illustrated in FIG. 2, the sound wave caused by the circulation of the exhaust gases and the two sound waves derived from the transducers 22 and 24 interfere with one another. The sound wave produced by the exhaust gases has the same frequency and the same amplitude as the counter-noise, but is in opposition of phase relative thereto. The transducer 22 supplies a high-frequency sound wave corresponding to the signal F1, whereas the second transducer 24 supplies a high-frequency wave containing the signal of the counter-wave $\Delta f_{cb}$. The interference of these three sound waves produces at the outlet a sound wave of which one of the components, resulting from the interference of the signals $2F1+\Delta f_{cb}+\Delta f_b$, is inaudible, since it has a very high frequency, and of which the other component, resulting from the interference of the signals $F1-(F1+\Delta f_{cb})+\Delta f_b$, is continuous. $2F1+\Delta f_{cb}+\Delta f_b$ and $F1-(F1+\Delta f_{cb})+\Delta f_b$ correspond to the superimposition of the waves.

It will thus be seen that the audible component of the exhaust gas noise produced by the motor is eliminated at the outlet of the exhaust line.

Moreover, since the sound sources 22 and 24 used are controlled so as to produce a high-frequency sound wave, these sources may be very small and consist, in particular, of piezoelectric elements. The noise attenuation device therefore has a very light weight.

The invention claimed is:

1. A method for attenuating the low frequency noise generated at the outlet (18) of an exhaust line (14), wherein it comprises the steps of:

defining a signal ($\Delta f_b$) representing the noise to be attenuated, emitting a first high-frequency sound wave (F1) from a first transducer (22) into an attenuation zone (26) of the exhaust line (14), which first high-frequency sound wave (F1) is inaudible and has a carrier frequency of higher than 50 kHz, and emitting a second high-frequency sound wave ($F1+\Delta f_{cb}$) from a second transducer (24) into the attenuation zone (26) of the exhaust line, the first and second transducers (22, 24) being configured for generating interference between the first and second sound waves in the attenuation zone (26), which second sound wave is inaudible and has as its carrier frequency the carrier frequency of the first high-frequency sound wave (F1) and contains a low-frequency counter-noise signal ($\Delta f_{cb}$), which is in opposition of phase to the signal ($\Delta f_b$) representing the noise to be attenuated.

2. The method as claimed in claim 1, wherein the frequency of the counter-noise signal is between 10 and 1,000 Hz.

3. A device for attenuating the noise generated at the outlet (18) of an exhaust line (14), wherein it comprises:

means (34, 36) for defining a signal representing the noise to be attenuated, means (32) for producing a low-frequency counter-noise signal ($\Delta f_b$), which is in opposition of phase to the signal representing the noise to be attenuated, a first and a second transducer (22, 24) arranged in an attenuation zone (26) of the exhaust line (14), the first and second transducers (22, 24) being configured for generating interference between the sound waves that are produced and present in the attenuation zone (26), means (30) for controlling the first transducer (22) for emitting a first high-frequency sound wave (F1), which first high-frequency sound wave (F1) is inaudible and has a carrier frequency of higher than 50 kHz, and means (30, 32, 38) for controlling the second transducer (24) for emitting a second high-frequency sound wave, which second high-frequency sound wave ($F1+\Delta f_{cb}$) is inaudible and has as its carrier frequency the carrier frequency of the first high-frequency sound wave (F1) and contains the low-frequency counter-noise signal ($\Delta f_b$), which is in opposition of phase to the signal representing the noise to be attenuated.

4. The device as claimed in claim 3, wherein the first and second transducers are piezoelectric transducers.

5. The device as claimed in claim 4, wherein said piezoelectric transducers are lead zirconate titanate-based.

6. The device as claimed in claim 3, wherein said means for defining a noise signal comprise a microphone (36) for recording the residual noise (Δϵ) at the outlet of the exhaust line (12).

7. The device as claimed in claim 3, wherein said means for defining a noise signal comprise a unit (32) for monitoring the ignition frequency of the engine.

8. An installation for powering a motor vehicle, wherein it comprises a heat engine (12), an exhaust line (14) and a noise attenuation device (20) as claimed in claim 3, the first and second transducers (22, 24) being arranged on the exhaust line (14).

9. The device as claimed in claim 5, wherein said means for defining a noise signal comprise a microphone (36) for recording the residual noise ($\Delta\epsilon$) at the outlet of the exhaust line (12).

10. The device as claimed in claim 5, wherein said means for defining a noise signal comprise a microphone (36) for recording the residual noise ($\Delta\epsilon$) at the outlet of the exhaust line (12).

11. The device as claimed in claim 4, wherein said means for defining a noise signal comprise a unit (32) for monitoring the ignition frequency of the engine.

12. The device as claimed in claim 5, wherein said means for defining a noise signal comprise a unit (32) for monitoring the ignition frequency of the engine.

13. An installation for powering a motor vehicle, wherein it comprises a heat engine (12), an exhaust line (14) and a noise attenuation device (20) as claimed in claim 4, the first and second transducers (22, 24) being arranged on the exhaust line (14).

14. An installation for powering a motor vehicle, wherein it comprises a heat engine (12), an exhaust line (14) and a noise attenuation device (20) as claimed in claim 5, the first and second transducers (22, 24) being arranged on the exhaust line (14).

15. The method as claimed in claim 1, wherein the carrier frequency is equal to 100 kHz.

16. The method as claimed in claim 2, wherein the carrier frequency is equal to 100 kHz.

* * * * *